US011266555B2

(12) United States Patent
Dodds

(10) Patent No.: US 11,266,555 B2
(45) Date of Patent: Mar. 8, 2022

(54) MOBILITY ASSIST DEVICE FOR MANEUVERING ON A BED AND METHOD OF USING

(71) Applicant: Margot Whitfield Dodds, Lakeview, OR (US)

(72) Inventor: Margot Whitfield Dodds, Lakeview, OR (US)

( * ) Notice: Subject to any disclaimer, the term of this patent is extended or adjusted under 35 U.S.C. 154(b) by 34 days.

(21) Appl. No.: 17/065,187

(22) Filed: Oct. 7, 2020

(65) Prior Publication Data

US 2021/0113400 A1 Apr. 22, 2021

Related U.S. Application Data

(60) Provisional application No. 62/923,705, filed on Oct. 21, 2019.

(51) Int. Cl.

| | |
|---|---|
| ***A61G 7/053*** | (2006.01) |
| ***A61G 7/05*** | (2006.01) |
| ***A61H 3/00*** | (2006.01) |

(52) U.S. Cl.

CPC ..... *A61G 7/053* (2013.01); *A61H 3/00* (2013.01); *A61G 7/05* (2013.01)

(58) Field of Classification Search

CPC ..... A61G 7/053; A61G 7/05; A61H 3/00
USPC ..... 5/662, 658; 135/67
See application file for complete search history.

(56) References Cited

U.S. PATENT DOCUMENTS

| | | | | |
|---|---|---|---|---|
| 2,445,619 | A * | 7/1948 | Josephs | A61G 7/053 5/81.1 R |
| 3,115,338 | A | 12/1963 | Acs et al. | |
| 3,668,723 | A * | 6/1972 | Bratton | A01N 43/56 5/658 |
| 3,739,793 | A * | 6/1973 | Wilson | A61G 7/053 5/503.1 |
| 4,351,525 | A * | 9/1982 | Rozenblad | A63B 23/12 482/141 |
| 4,836,523 | A * | 6/1989 | Englander | A61G 13/12 5/623 |
| 4,922,560 | A * | 5/1990 | Skibinski | A61G 7/1038 135/67 |
| 5,305,773 | A * | 4/1994 | Browning | A61G 7/053 135/65 |
| 5,397,169 | A * | 3/1995 | Willans | A61G 5/14 297/411.23 |
| 5,449,013 | A * | 9/1995 | Landers | A61G 7/053 135/67 |

(Continued)

*Primary Examiner* — Robert G Santos
(74) *Attorney, Agent, or Firm* — Jose R Mata

(57) ABSTRACT

A given mobility assist device may include at least two paddles, at least one including (1) a base defining upper and lower surfaces, the lower surface configured for supporting the base on a mattress, a first end, a second end, a longitudinal axis, a length along the longitudinal axis, and a width, the length greater than the width; and (2) a handle integral with or coupled with the base along its longitudinal axis or along an axis at least substantially parallel with the longitudinal axis and having a gripping portion, the at least one paddle configured for the handle to be gripped with the user's wrist in an anatomically neutral position with at least one of the longitudinal axis of the base or a longitudinal axis of the handle being at least substantially parallel to a sagittal plane through the user.

28 Claims, 5 Drawing Sheets

(56) References Cited

U.S. PATENT DOCUMENTS 5,465,744 A * 11/1995 Browning ..... A61G 7/053 135/67
5,471,689 A * 12/1995 Shaw ..... A47C 21/08 5/662
5,509,432 A * 4/1996 Peterson ..... A61G 7/1038 135/65
5,983,911 A * 11/1999 Steele ..... A61G 5/1094 135/66
6,244,285 B1 * 6/2001 Gamache ..... A47C 21/08 135/66
6,357,064 B1 * 3/2002 Totsky ..... A61G 7/053 5/81.1 R
D523,493 S 6/2006 Horton
D579,503 S 10/2008 Hauser et al.
7,468,025 B2 12/2008 Hauser et al.
7,481,753 B2 1/2009 James et al.
D593,168 S 5/2009 Khubani
7,553,267 B1 6/2009 Hauser et al.
D599,417 S 9/2009 Friedman et al.
7,775,228 B2 * 8/2010 Clark ..... A61G 7/1038 135/66
7,862,122 B1 * 1/2011 Shammas ..... B60N 2/787 297/411.23
7,951,055 B2 5/2011 Mulderrig et al.
8,105,218 B1 1/2012 Vayntraub
8,480,547 B2 7/2013 Coates
9,241,854 B2 * 1/2016 Gentile ..... A61G 5/14
9,561,146 B2 * 2/2017 Miller ..... A47C 31/00
9,808,386 B2 * 11/2017 Gentile ..... A47C 7/546
10,285,887 B2 * 5/2019 Woolway ..... A63B 21/00
11,191,689 B1 * 12/2021 Terebus ..... A61G 5/12
2006/0014615 A1 1/2006 Godbold
2006/0035771 A1 2/2006 Gant
2010/0078052 A1 * 4/2010 Clark ..... A61G 7/1038 135/65
2010/0210430 A1 * 8/2010 Mulderrig ..... A63B 21/4035 482/141
2011/0230312 A1 9/2011 Gamboa
2011/0230319 A1 9/2011 Mulderrig et al.
2013/0316886 A1 11/2013 Lynch et al.
2015/0061342 A1 * 3/2015 Gentile ..... A61G 5/14 297/411.4
2015/0224004 A1 * 8/2015 Miller ..... A61G 7/053 135/65
2016/0095771 A1 * 4/2016 Gentile ..... A47C 7/546 297/183.4
2018/0318159 A1 * 11/2018 Woolway ..... A63B 23/00
2021/0113400 A1 * 4/2021 Dodds ..... A61G 7/053

* cited by examiner

MOBILITY ASSIST DEVICE FOR MANEUVERING ON A BED AND METHOD OF USING

RELATED APPLICATIONS

This application claims priority to U.S. Provisional Application No. 62/923,705, filed Oct. 21, 2019.

TECHNICAL FIELD

This application relates to a mobility assist device for maneuvering on a bed. In particular, this application relates to a mobility assist device for maneuvering on a bed, the mobility assist device being configured to be used with a wrist of a user in an anatomically neutral position.

BACKGROUND

Among the essential activities of everyday life is maneuvering on a bed, including getting in and out of bed and scooting around on the bed.

"Getting into a bed" may involve maneuvering the body from a seated position at the edge of the bed, perhaps perpendicular to the bed's longitudinal axis, to a position in the center of the bed, for example with the longitudinal axis of the body aligned with that of the bed.

"Getting out of bed" involves maneuvering the body from a position in the bed, for example in the center of the bed with the longitudinal axis of the body aligned with the longitudinal axis of the bed, to a seated position on the end of the bed, perpendicular to the bed's longitudinal axis.

Scooting around involves the individual pushing down on the bed surface with both hands and scooting the buttocks in the intended direction.

These are activities that most people successfully do on their own, unassisted, on a daily basis. But sometimes assistance is needed. This could be due to illness, injury, disability or other reasons.

In regards to scooting, scooting around on a bed actually requires a significant amount of strength and agility. There are at least three problems with unassisted scooting:

a. It requires a significant amount of effort for a person to raise the buttocks off the surface of the bed, or at least reduce the force that the buttocks are applying. When pushing down the person's hands sink into the mattress, so the buttocks do not get raised very far. If the person makes a fist, the fist sinks deeper than does an open hand.
b. When the person pushes down with an open hand, there is strain on the wrists because the hand is forced into a 90-degree angle with respect to the forearm while bearing weight.
c. As a person drags their buttocks across the mattress, the skin is subjected to shearing forces which may cause injury.

While many take their ability to do the above for granted, for too many, these pose significant challenges. The need for assistance arises for many in a variety of settings including one or more of a convalescent setting, hospital setting, home care setting, or self-care setting. Assistance can be provided by persons, such as nurses or other health care providers. There are also mechanical devices or systems.

Existing mechanical aids for maneuvering on a bed include devices that attach to a bed, such as grips, handholds and above-bed "trapeses."

SUMMARY

The following summary introduces at a high level a limited number of topics described in the Detailed Description. This summary is not intended to identify key or essential features and should not be used for that purpose. In addition, this summary is not intended to be used as a guide to the scope of the claims. Instead, this Summary is provided as an introduction for the reader.

In some embodiments a mobility assist device includes at least two paddles, at least one paddle of the two paddles including at least a base defining an upper surface and a lower surface, the lower surface being configured for supporting the base on a mattress of a bed, the base further defining a first end, a second end opposite the first end, a longitudinal axis, a length along the longitudinal axis between the first and second ends, and a width, the length being greater the width.

In some further embodiments the at least one paddle further including at least a handle at least one of integral with or coupled with the base along its longitudinal axis or along an axis that is at least substantially parallel with the longitudinal axis and having a least a gripping portion configured for gripping with a hand of a user, the at least one paddle configured for the handle to be gripped with the wrist of the user in an anatomically neutral position in which the gripping portion is gripped by a hand of the user while at least one of the longitudinal axis of the base or a longitudinal axis of the handle is at least substantially parallel to a sagittal plane through the user.

And in some further embodiments the mobility assist device is thereby at least partly configured for assisting the user to maneuver about the mattress of the bed and to get in and out of bed.

Some embodiments also provide a method of using a mobility assist device.

BRIEF DESCRIPTION OF THE DRAWINGS

Various embodiments are described below with reference to drawings which are now summarized. It should be noted that these drawings are not necessarily to scale. In addition, the drawings are simplified to avoid obscuring important principles with unnecessary details.

DETAILED DESCRIPTION

Figure 1A:
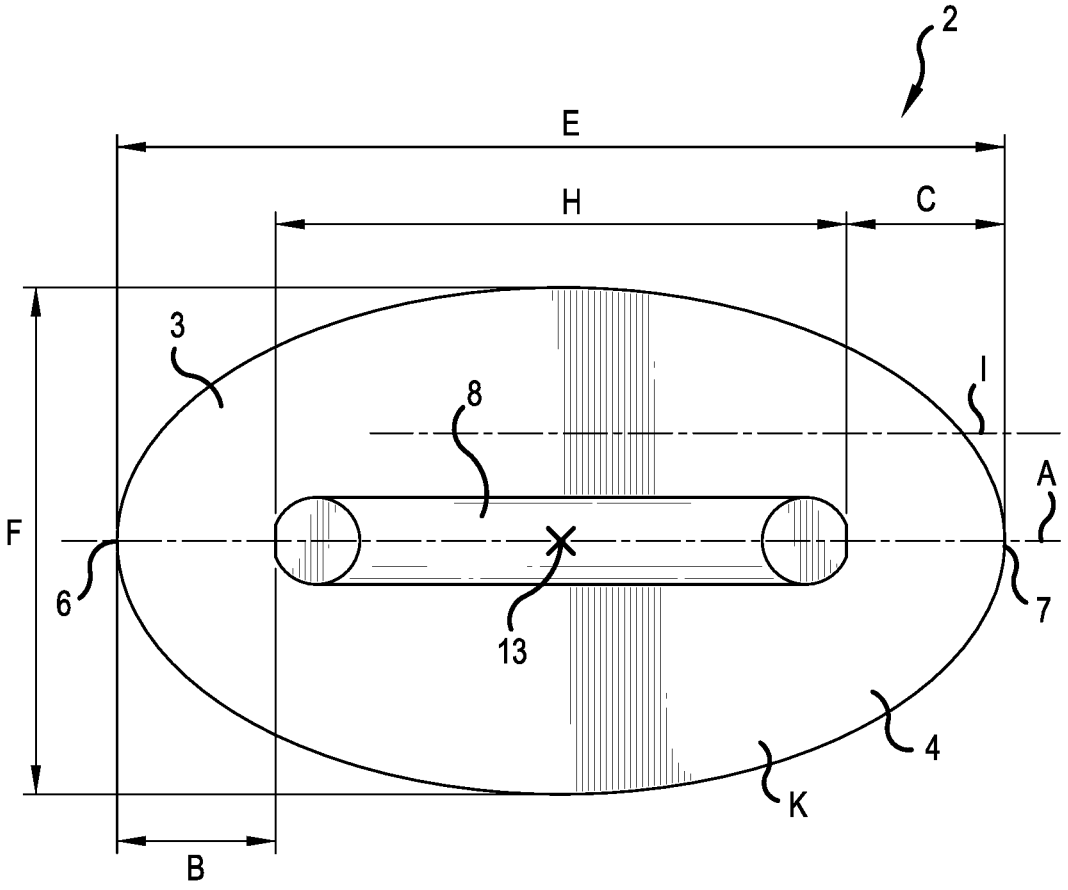
FIG. 1*a* is a two-dimensional top-view drawing of a mobility assist device, consistent with some embodiments.
Figure 1B:
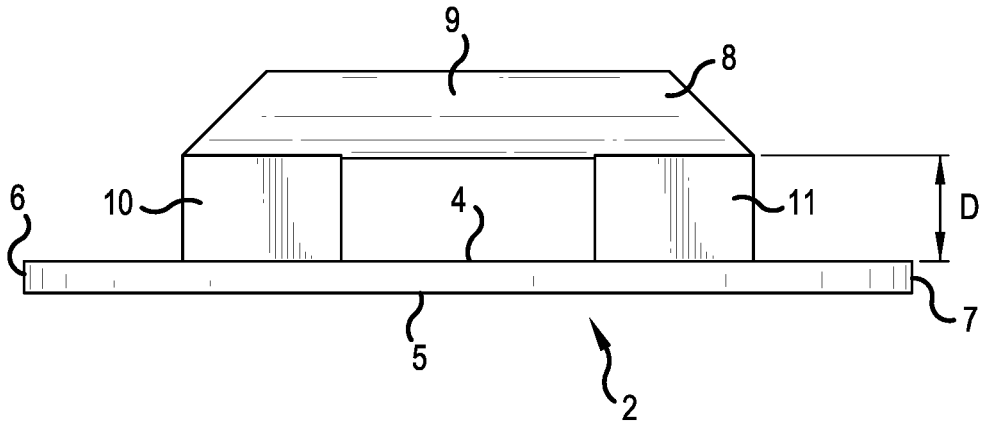
FIG. 1*b* is a two-dimensional side view drawing of the mobility assist device of FIG. 1*a* consistent with some embodiments.
Figure 1C:
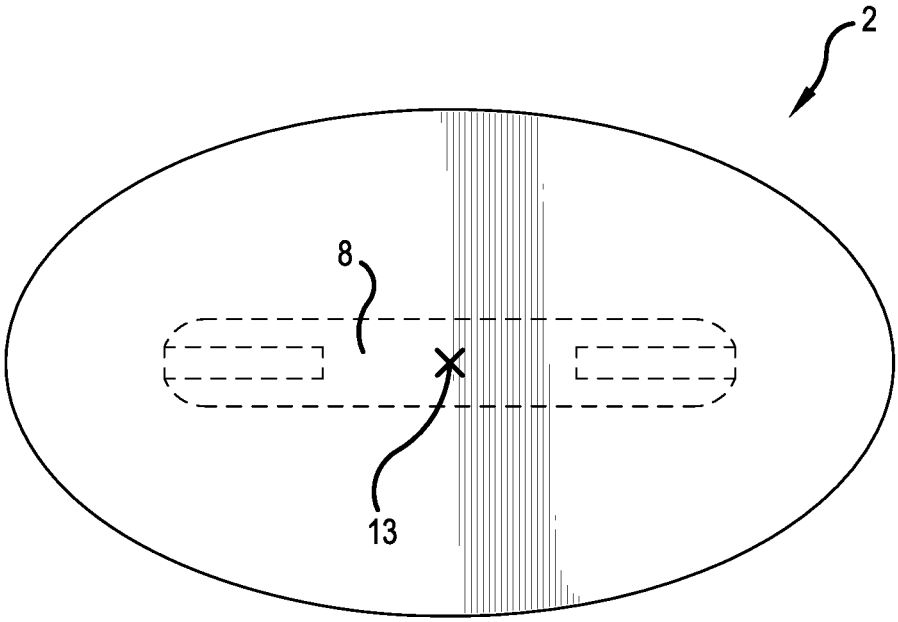
FIG. 1*c* is a two-dimensional bottom view drawing of the mobility assist device of FIG. 1*a* consistent with some embodiments.
Figure 1D:
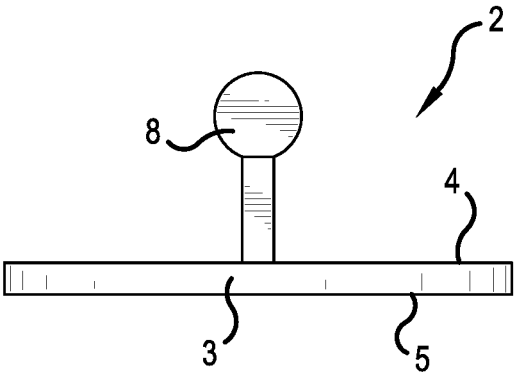
FIG. 1*d* is a two-dimensional end view drawing of the mobility assist device of FIG. 1*a* consistent with some embodiments.

Some embodiments are now described with reference to the above-described figures. In the following description, multiple references are often made to "some embodiments," "some further embodiments," "some particular embodiments," and the like. These references to "some embodiments," "some further embodiments," "some particular embodiments," or similar terminology are not necessarily referring to the same embodiments, as numerous and varied embodiments are possible. No effort is made to describe all possible embodiments. Sufficient embodiments are described so that those skilled in the art will become appraised of the relevant principles. In addition, disclosed embodiments are not necessarily preferred or advantageous over other embodiments. Further all drawings illustrate merely example embodiments. Specific details in the drawings should not be used to limit the claims.

As used in this Application, "maneuvering" on a bed includes at least one of getting onto a bed, getting out of a bed, or scooting on a bed for whatever purpose. References to maneuvering on a bed also refer to maneuvering on a mattress of whatever type, whether traditional mattress, futon, or other.

As discussed above, existing mechanical aids include devices, such as grips or handholds, attached to a bed. These may still require human assistance. They provide only minimal assistance with helping a person press down into a mattress to raise their buttocks above the mattress for maneuverability. They also do little to prevent skin shearing forces. Another existing mechanical aid is known as the above-bed trapeze. These often include an L-shaped bar attached to a bed frame with a trapeze bar hanging from the short end of the L. These devices are not actually helpful for getting into and out of bed. There is also a risk of the user being accidentally hit by the hanging trapeze bar. These above-bed trapezes also do not assist the user raise their buttocks off the mattress by pressing down on the mattress. Thus, there is a need for new technology that overcomes one or more of the above problems by assisting with both getting onto and out of bed and with scooting on the bed.

Embodiments of a mobility assist device disclosed herein act as an extension of a user's arm in maneuvering on a bed, thereby providing assistance through the full process of getting into or out of bed. It also provides assistance in scooting on a bed. They are like "snowshoes" for the hand.

Some embodiments of a mobility assist device include two paddles. An example paddle includes a base with a handle (e.g. a U-shaped handle). The base includes a lower surface for engaging the bed (e.g. mattress of the bed). The base also includes an upper surface, the handle being either attached to or integral with the base at the upper surface. The base is longer along a longitudinal axis that passes through a centroid of the base. The handle is attached or integral with the base along this longitudinal axis or along an axis that is at least substantially parallel to the longitudinal axis.

Consistent with some embodiments, the mobility assist device is configured to be gripped in a user's hands with the wrists in an anatomically neutral position, that is a position in which at least one of the longitudinal axis of the base or a longitudinal axis of the handle is at least substantially parallel (e.g. within 10, 20, or 25 degrees of parallel) with a sagittal plane dividing the user's right side from the user's left side.

When in use by a user maneuvering on a bed, some embodiments of a mobility assist device offer one or more of the following advantages:

a. The hands of the user do not sink into the mattress. This makes it easier to raise the user's buttocks off the surface of a mattress.
b. The wrists are in an anatomically neutral position. For example, they avoid strain on the wrist caused by having a user's hand forced into an angle (e.g. a ninety degree angle) with respect to the user's forearm while bearing weight.
c. The user's buttocks are raised off of the mattress thereby making maneuvering easier. Thus, the user's skin is not subjected to shearing forces that may cause injury.

Some embodiments provide one or more of the above advantages based on one or more of the following:

a. The surface area of the paddle's base is significantly greater than the surface area of a user's open hand. Consequently, when a user holding a paddle pushes downward on the surface of a bed (e.g. surface of a mattress), the paddle will sink into the bed a smaller distance than would the open hand. This reduction in downward deflection into the bed will result in a greater upward translation of the buttocks, consequently making it easier to scoot along the surface of the bed.
b. The handle is located above the base and is oriented on the longitudinal axis of the base or on a horizontal axis parallel to the longitudinal axis. The user holds the handle as if it were a stairway railing—an anatomically neutral grip.
c. The handle is positioned over the base so that the downward force is directed through the base's centroid, providing a stable platform.
d. The handle being located higher than the base results in further upward translation of the buttocks.
e. The orientation of the handle with respect to the base aligns the wrist with the direction of applied force, thereby reducing strain on the wrist.

As noted above the bases of the paddles have sufficient square area to minimize or reduce sinking into the mattress when the user pushes down on the paddles. Also, the bases of these paddles have a length along their longitudinal axis that is substantially greater than that of the handle of the paddle and also greater than the width of the base, directing a substantial portion of the square area of the base in a lengthwise direction along the longitudinal axis of the base. In some embodiments the length of the handle is only 50 to 70 percent, inclusive, of the length of the base along its longitudinal axis. This provides a user with improved leverage relative to having a shorter length along the longitudinal axis of the base and avoids having an overly wide base that could contact the user's buttocks as the user attempts to maneuver on the bed.

Turning to FIGS. 1*a*-1*d*, in some embodiments a paddle 2 includes at least a base 3 and a handle 8. The base 3 defines an upper surface 4, a lower surface 5, a first end 6, and a second end 7 opposite the first end 6. The base 3 further defines a longitudinal axis A, a length of the base E along the longitudinal axis A between the first and the second ends 6, 7, and a width F of the base 3. The base 3 further defines a square area K, which is at least partly a function of width F and length E.

Continuing with reference to FIGS. 1*a*-1*d*, in some embodiments the handle 8 includes a first leg 10 and a second leg 11 that are at least one of coupled with or integral with the upper surface 4 of the base 3 either along a longitudinal axis A of the base 3 or along an axis I at least substantially parallel (e.g. within at least one of 15, 20, or 30 degrees of parallel) to the longitudinal axis A. The longitudinal axis A passes through a centroid 13 of the base 3. The handle 8 further includes a gripping portion 9 disposed between the first and second legs 10, 11. The handle 8 defines height D between upper surface 4 and gripping portion 9. The handle 8 further defines a longitudinal axis J (See FIGS. 2 and 3) and a length H along longitudinal axis J. In some embodiments longitudinal axis J of handle 8 is at least at least substantially parallel to longitudinal axis A of base 3. In some embodiments, substantially parallel includes within at least one of 15, 20, or 30 degrees of parallel. Paddle 2 further defines a first distance B between first leg 10 and first end 6 and a second distance C between second leg 11 and second end 7.

Figure 2:
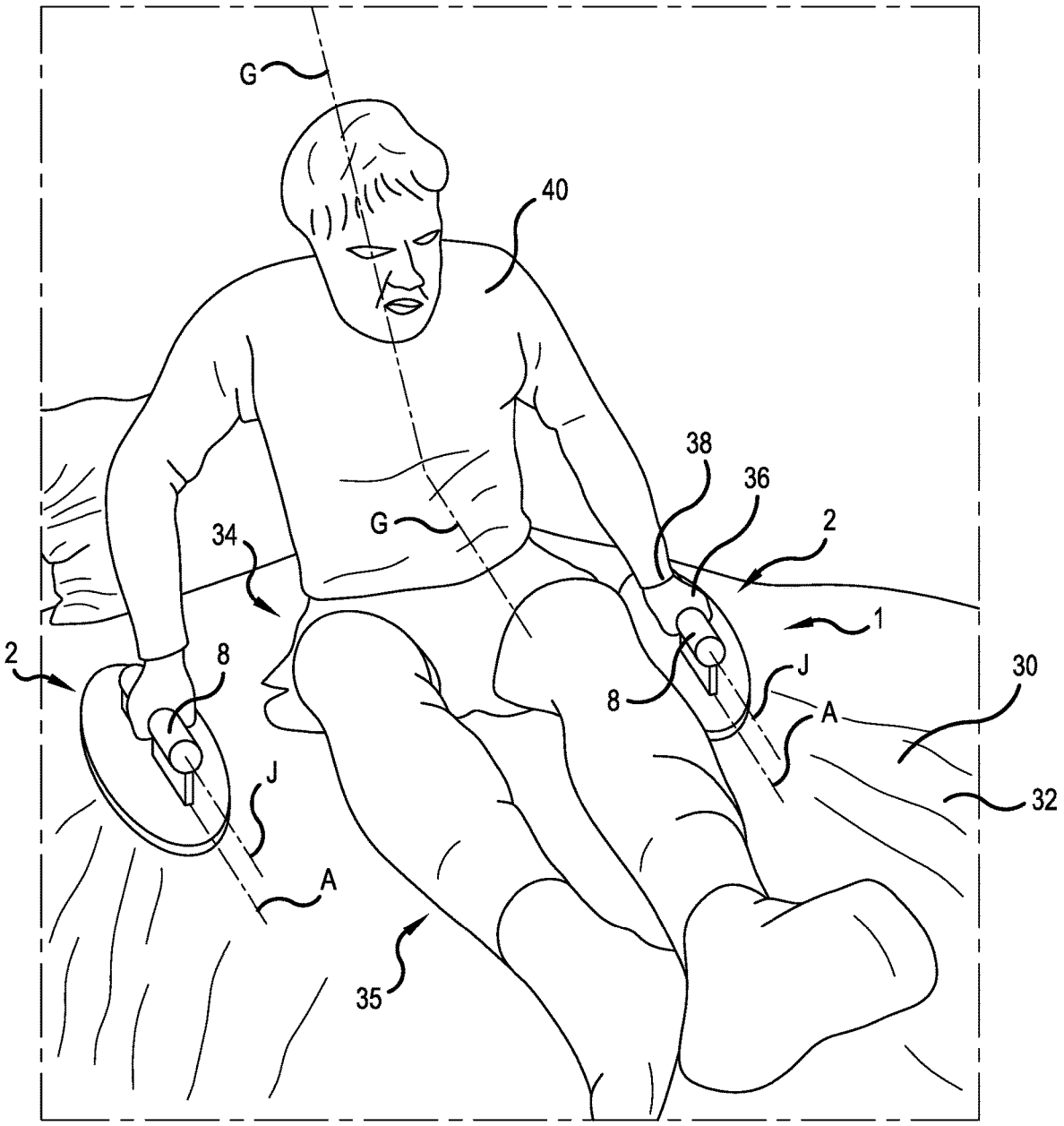
FIG. 2 is a perspective view of a user using the mobility assist device of FIGS. 1*a*-1*d*, showing the user sitting up in a bed.

Moving forward with reference to FIG. 2, in some embodiments a mobility assist device 1 includes two paddles 2. A user 40 may sit up on a mattress 30 of a bed 32, on his buttocks 34, while holding paddles 2 in his hands 36 with wrists 38 at least partly in an anatomically neutral position (e.g. at least one of the longitudinal axes A of the bases 3 or the longitudinal axes J of the handles 8 are at least substantially parallel (e.g. being within at least one of 15, 20, or 30 degrees of parallel) to the user's legs 35). The user's body may be divided between left and right sides by a sagittal plane G. Another way of noting an anatomically neutral position is to note at least one of the longitudinal axes A of the bases 3 or longitudinal axes J of the handles 8 being at least substantially parallel (e.g. being within at least one of 15, 20, or 30 degrees of parallel) to a sagittal plane G through the body of user 40. In the discussion herein, reference number 40 is used interchangeably to refer to the user 40 or the user's body 40.

Figure 3:
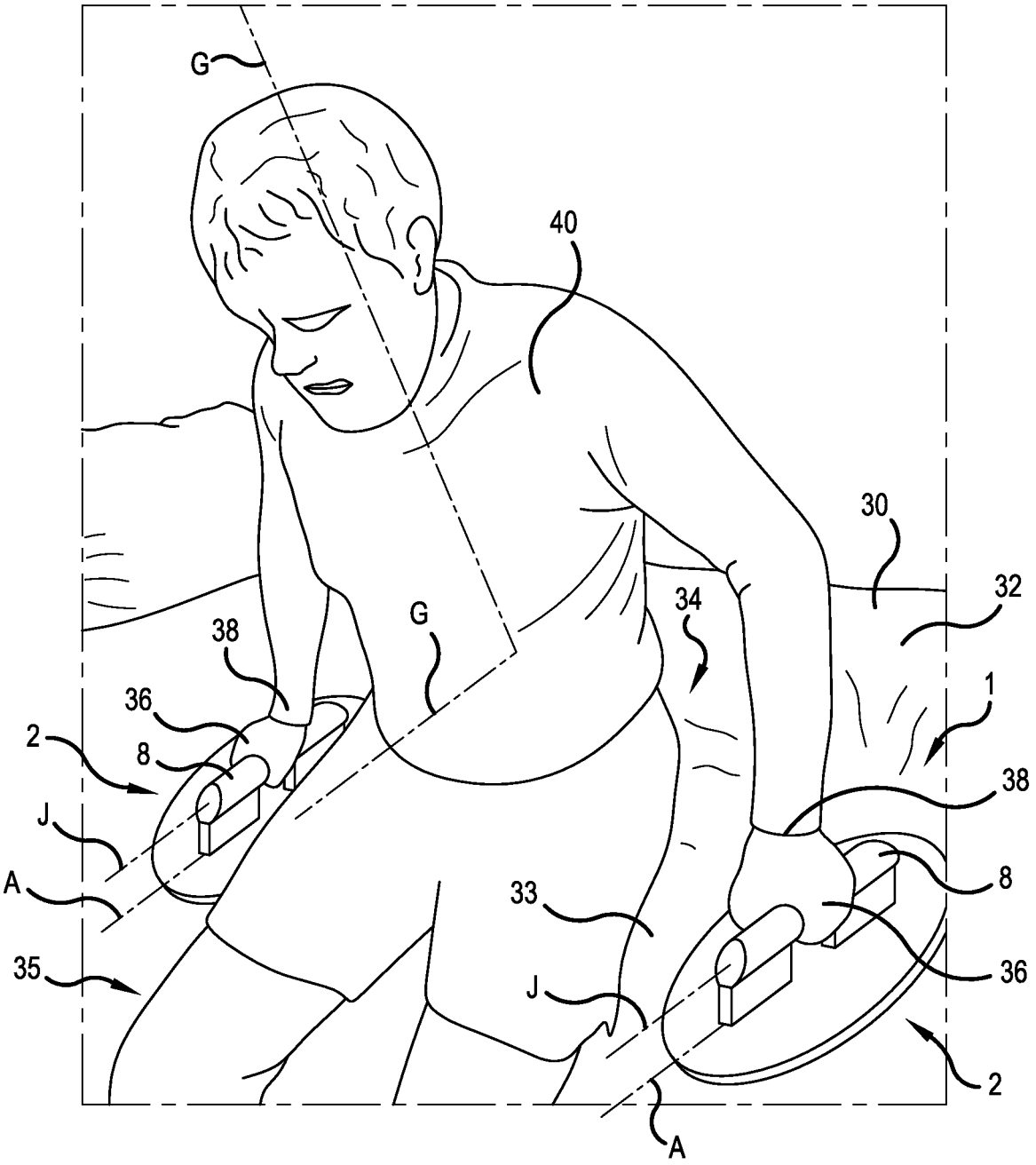
FIG. 3 is a perspective view of the user of FIG. 2 using the mobility assist device of FIGS. 1*a*-1*d*, showing the user sitting on an edge of the bed preparatory to standing up.

Moving forward with reference to FIG. 3, the user 40 of FIG. 2 has maneuvered to an edge 33 of the bed 32 while holding the handles 8 of the paddles 2 of mobility assist device 1 with his hands 36. The user continues to have his wrists 38 substantially in an anatomically neutral position (See discussion above regarding FIG. 2). From this position user could press the paddles 2 against the edge 33 of the bed 32 for assistance in standing.

Particular embodiments are now described with reference to FIGS. 1*a*-1*d* and 2-3. In some embodiments a mobility assist device (e.g. mobility assist device 1) includes at least two paddles (e.g. paddles 2). In some embodiments at least one paddle (e.g. paddle 2) of the two paddles (e.g. paddles 2) includes at least a base (e.g. base 3) defining an upper surface (e.g. upper surface 4) and a lower surface (e.g. lower surface 5), the lower surface (e.g. lower surface 5) being configured for supporting the base (e.g. base 3) on a mattress (e.g. mattress 30) of a bed (e.g. bed 32), the base (e.g. base 3) further defining a first end (e.g. first end 6), a second end (e.g. second end 7), a longitudinal axis (e.g. longitudinal axis A), a length (e.g. length E) along the longitudinal axis (e.g. longitudinal axis A) between the first end and second end (e.g. first and second ends 6, 7) and a width (e.g. width F), the length being greater the width. In some embodiments the width (e.g. width F) is orthogonal to the length (e.g. length E). In some embodiments, longitudinal axis (e.g. longitudinal axis A) passes through a centroid (e.g. centroid 13) of the base 3. Base 3 further defines a square area (e.g. square area K) which is at least partly a function of a length (e.g. length E) that is greater than its width (e.g. width F). This square area (e.g. square area K) is greater than a square area of a typical hand. The square area (e.g. square area K) functions (to a greater degree than a square area of a typical hand) to minimize or reduce the sinking of the base (e.g. base 3) into a mattress (e.g. mattress 30) when a paddle (e.g. paddle 2) is pressed against the mattress (e.g. mattress 30). This square area (e.g. square area K) can be greater lengthwise (e.g. along longitudinal axis A) because the length (e.g. length E) can be increased (e.g. as compared with width F) without risk of encountering a user's (e.g. user 40) buttocks (e.g. buttocks 34) and interfering with the user's (e.g. user 40) movement.

In some embodiments the at least one paddle (e.g. paddle 2) further includes at least a handle (e.g. handle 8) at least one of integral with or coupled with the base (e.g. base 3) along its longitudinal axis (e.g. longitudinal axis A) or along an axis (e.g. axis I) that is at least substantially parallel (e.g. within at least one of 15, 20, or 30 degrees of parallel) with the longitudinal axis (e.g. longitudinal axis A) and having a least a gripping portion (e.g. gripping portion 9) configured for gripping with a hand (e.g. hand 36) of a user (e.g. user 40), the at least one paddle (e.g. paddle 2) configured for the handle (e.g. handle 8) to be gripped with the wrist (e.g. wrist 38) of the user (e.g. user 40) in an anatomically neutral position in which the gripping portion (e.g. gripping portion 9) is gripped by a hand (e.g. hand 36) of the user (e.g. user 40) while at least one of the longitudinal axis (e.g. longitudinal axis A) of the base (e.g. base 3) or a longitudinal axis (e.g. longitudinal axis J) of the handle (e.g. handle 8) is at least substantially parallel to a sagittal plane (e.g. sagittal plane G) through the user (e.g. user 40). In some embodiments substantially parallel includes within at least one of 15, 20, or 30 degrees of parallel.

In some embodiments the mobility assist device (e.g. mobility assist device 1) is thereby at least partly configured for assisting the user (e.g. user 40) to maneuver about the mattress (e.g. mattress 30) of the bed. In some further embodiments, the mobility assist device (e.g. mobility assist device 1) is thereby at least partly configured for assisting the user (e.g. user 40) to maneuver about the mattress (e.g. mattress 30) of the bed (e.g. bed 32) at least in part by being configured to assist the user (e.g. user 40) with at least one of getting into the bed (e.g. bed 32), getting out of the bed (e.g. bed 32), or scooting about the bed (e.g. bed 32).

In some embodiments, the lower surface (e.g. lower surface 5) is a flat surface. In some alternative embodiments the lower surface (e.g. lower surface 5) is at least one of at least partially concave or at least partially convex. In some embodiments, the base (e.g. base 3) is solid without perforations or holes.

In some embodiments the width (e.g. width F) of the base (e.g. base 3) is between 45 percent and 70 percent, inclusive, of the length (e.g. length E) of the base (e.g. base 3) with, in particular embodiments, the length (e.g. length E) of the base (e.g. base 3) being greater than 12 inches and in some further embodiments, the length (e.g. length E) of the base (e.g. base 3) being greater than 14 inches. Thus, in these embodiments a greater surface area (e.g. square area K) is provided by having a greater length (e.g. length E) compared to width (e.g. width F). If the width (e.g. width F) were greater it could result in an overly wide width (e.g. width F) that could reach and/or interfere with movement of the user's (e.g. user 40) buttocks (e.g. buttocks 34).

In some embodiments a length (e.g. length H) of the handle (e.g. handle 8) is between 50 percent and 70 percent, inclusive, of the length (e.g. length E) of the base (e.g. base 3) with the length of the base being greater than 12 inches, and in some particular embodiments, the length of the base greater than 14 inches. In some further embodiments, the length (e.g. length H) of the handle 8 is measured along at least a portion of the longitudinal axis (e.g. longitudinal axis J) of the handle (e.g. handle 8). In some embodiments, at least a portion of the gripping portion of the handle is at least substantially horizontal with respect to the upper surface of the base. In some embodiments, substantially horizontal includes within at least one of 15, 20, or 30 degrees of horizontal. Having the length (e.g. length H) of the handle (e.g. handle 8) between 50 percent and 70 percent, inclusive, of the length (e.g. length E) of the base (e.g. base 3) results in greater overall length (e.g. length E) of the base (e.g. base 3) which results in more of the square area (e.g. square area K) of the base (e.g. base 3) being lengthwise along the longitudinal axis (e.g. longitudinal axis A) as contrasted with along its width (e.g. width F).

In some embodiments, the handle is a handle (e.g. handle 8) with first and second legs (e.g. first and second legs 10 and 11) extending from the upper surface (e.g. upper surface 4) of the base (e.g. base 3), the first and second legs (e.g. first and second legs 10 and 11) being disposed along the longitudinal axis (e.g. longitudinal axis A) of the base (e.g. base 3), or along an axis (e.g. axis I) that is at least substantially parallel with the longitudinal axis (e.g. longitudinal axis A) with the first leg (e.g. first leg 10) disposed at a first distance (e.g. first distance B) from the first end (e.g. first end 6) and the second leg (e.g. second leg 11) disposed at a second distance (e.g. second distance C) from the second end (e.g. second end 7), the handle (e.g. handle 8) defining a gripping portion (e.g. gripping portion 9) configured for gripping by a hand (e.g. hand 36), at least a portion of the gripping portion (e.g. gripping portion 9) being disposed at a height (e.g height D) above the upper surface (e.g. upper surface 4) of the base (e.g. base 3) that prevents the hand from contacting the upper surface (e.g. upper surface 4) of the base (e.g. base 3) when the hand (e.g. hand 36) is gripping the gripping portion (e.g. gripping portion 9). In some further embodiments at least one of the first distance (e.g. first distance B) or the second distance (e.g. second distance C) is between 15 percent and 25 percent of the length (e.g. length E) of the base (e.g. base 3). In some further embodiments at least one of the first distance (e.g. first distance B) or the second distance (e.g. second distance C) is between 2.5 and 4 inches.

In some embodiments, at least a portion of at least one of the first leg (e.g. first leg 10) or the second leg (e.g. second leg 11) is at least substantially vertical with respect to at least a portion of the lower surface (e.g. lower surface 5) of the base (e.g. base 3). In some embodiments, substantially vertical includes within at least one of 15, 20, or 30 degrees of vertical.

In some embodiments at least a portion of the gripping portion (e.g. gripping portion 9) of the handle (e.g. handle 8) is at least substantially horizontal with respect to at least a portion of the lower surface (e.g. lower surface 5) of the base (e.g. base 3). In some embodiments, substantially horizontal includes within at least one of 15, 20, or 30 degrees of horizontal.

In some embodiments the handle (e.g. handle 8) and the base (e.g. base 3) are integral with one another to form a one-piece paddle (e.g. a one-piece version of paddle 2). In some further embodiments, the one-piece paddle is an injection molded plastic paddle.

In some embodiments the handle (e.g. handle 8) and the base (e.g. base 3) are separate parts of the paddle (e.g. two-piece version of paddle 2), the handle (e.g. handle 8) being coupled with the base (e.g. base 3). In some further embodiments, the base (e.g. base 3) may be a plate (e.g. a plate of metal or a flat piece of wood). In some further embodiments, the handle (e.g. handle 8) is a u-shaped handle (e.g. made of plastic, metal, wood, etc.). In some further embodiments, the base (e.g. base 3) and the handle (e.g. handle 8) may be coupled together in a variety of ways, including at least by being welded, bolted, or otherwise attached to each other.

In some further embodiments, the first leg (e.g. first leg 10) and the second leg (e.g. second leg 11) are integral with the gripping portion (e.g. gripping portion 9) of the handle (e.g. handle 8). In some embodiments, the first leg (e.g. first leg 10), second leg (e.g. second leg 11), and gripping portion (e.g. gripping portion 9) are a one-piece unit formed of an injection molded material, such as plastic.

In some other further embodiments the first leg (e.g. first leg 10) and the second leg (e.g. second leg 11) and the gripping portion (e.g. gripping portion 9) of the handle (e.g. handle 8) are separate parts that are coupled together to form the handle (e.g. handle 8). Thus, the first leg, second leg, and gripping portion may be separate parts that may be coupled together in a variety of ways, including at least by being welded, bolted, or otherwise attached to each other. Possible materials include metal (e.g. stainless steel), wood, plastic, or other rigid strong materials.

In some embodiments the base (e.g base 3) defines a centroid (e.g. centroid 13) along its longitudinal axis (e.g. longitudinal axis A) midway between the first end (e.g first end 6) and second end (e.g. second end 7) and wherein the gripping portion (e.g. gripping portion 9) of the handle (e.g handle 8) is positioned so that when gripped by a user's hand (e.g. hand 36), the user's hand (e.g. hand 36) is positioned over the centroid (e.g. centroid 13).

Figure 4:
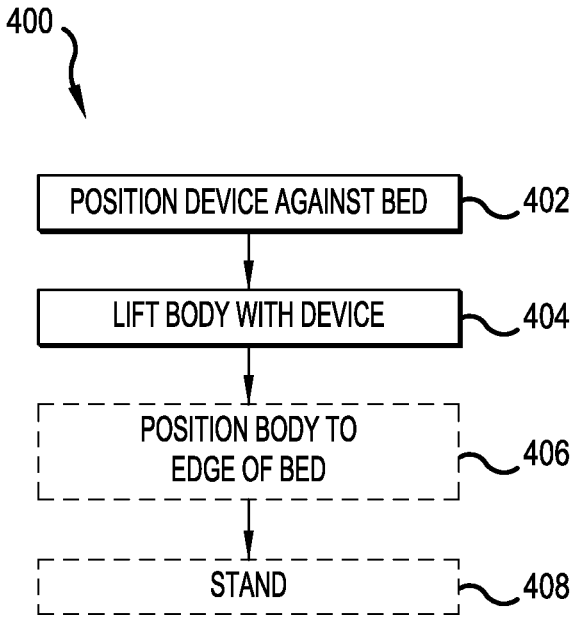
FIG. 4 is a flow chart illustrating a method of using a mobility assist device, consistent with some embodiments.

An exemplary method 400 of using a mobility assist device (e.g. mobility assist device 1) is now discussed with reference to FIG. 4. Regarding FIG. 4, process blocks in broken line are optional. Further, the order of process blocks does not necessarily imply a required order.

In some embodiments a method 400 of using a mobility assist device to maneuver on a mattress (e.g. mattress 30) of a bed (e.g. bed 32) is performed by a user (e.g. user 40) with a mobility assist device (e.g. mobility assist device 1) that includes at least two paddles (e.g. paddles 2) with each paddle (e.g. paddle 2) including at least a base (e.g. base 3) with a lower surface (e.g. lower surface 5) and a handle (e.g. handle 8), the method 400 including at least positioning (process block 402) the mobility assist device (e.g. mobility assist device 1) against the bed (e.g. bed 32). In some embodiments the positioning includes at least grasping the handles (e.g. handles 8) of the paddles (e.g. paddles 2) with the hands (e.g. hand 36) of the user (e.g. user 40) and placing the lower surfaces (e.g. lower surface 5) of the bases (e.g. bases 3) of the paddles (e.g. paddles 2) against the mattress (e.g. mattress 30) with the wrists (e.g. wrist 38) in an anatomically neutral position, the buttocks (e.g. buttocks 34) of the user (e.g. user 40) being in contact with the mattress (e.g. mattress 30).

In some embodiments method 400 further includes lifting (process block 402) the body (e.g. of user 40) with the mobility assist device (e.g. mobility assist device 1). The lifting including at least with the wrists (e.g. wrist 38) in the anatomically neutral position, pressing the lower surfaces (e.g. lower surfaces 5) of the paddles (e.g paddles 2) against the mattress (e.g. mattress 30), raising the user's buttocks (e.g. buttocks 34) above the mattress (e.g. mattress 30).

In some embodiments, method 400 is performed in at least one of a convalescent, hospital, home care setting, or self-care setting.

In some embodiments, method 400 further includes at least positioning the user's body to an edge of the bed (process block 406), the positioning the user's body being performed at least in part with the lifting of the body (e.g. body of user 40) with the mobility assist device (e.g. mobility assist device 1) and by swinging the user's legs (e.g. legs 35) out of the bed (e.g. bed 32) and sitting up at the edge (e.g. edge 33) of the bed (e.g. bed 32). The handles (e.g. handles 8) may optionally be released in preparation for the user (e.g. user 40) swinging the legs (e.g. legs 35) out of bed (e.g. bed 32).

In some embodiments, method 400 further includes standing (process block 408), the standing being performed with the user's body (e.g. user's body 40) at the edge (e.g. edge 33) of the bed (e.g. bed 32). In some further embodiments, the standing is further performed by at least:

a. at least one of gripping (e.g. if the handles were released preparatory to swinging the user's legs out of bed) or continuing to grip the handles (e.g. handles 8) of the paddles (e.g. paddles 2) with the hands (e.g. hand 36) of the user (e.g. user 40);

b. placing the lower surfaces (e.g. lower surfaces 5) of the bases (e.g. bases 3) of the paddles (e.g. paddles 2) against the mattress (e.g. mattress 30) with the wrists (e.g. wrists 38) in an anatomically neutral position, the buttocks (e.g. buttocks 34) of the user (e.g. user 40) being in contact with the mattress (e.g. mattress 30);

c. with the wrists (wrists 38) in the anatomically neutral position, pressing the lower surfaces (e.g. lower surfaces 5) of the paddles (e.g. paddles 2) against the mattress (e.g. mattress 30); and d. with the support of the paddles (e.g. paddles 2) against the mattress (e.g. mattress 30), standing.

Various embodiments of a mobility assist device may be made in a variety of ways. One piece paddles may be made at least via plastic injection molding, either ABS (acrylonitrile butadiene styrene), nylon, plastic, or resin with aerospace-grade carbon fibers, covered with antimicrobial sealant or with antimicrobial powder incorporated into the plastic.

Other modes of making a paddle include using laminate, veneer or wall covering plastic over lightweight wood or metal structure, covered with antimicrobial sealant.

It will be understood by those skilled in the art that the terminology used in this specification and in the claims is "open" in the sense that the terminology is open to additional elements not enumerated. For example, the words "includes" should be interpreted to mean "including at least" and so on. In addition, articles such as "a" or "the" should be interpreted as not referring to a specific number, such as one, unless explicitly indicated. At times a convention of "at least one of A, B, or C" is used, the intent is that this language includes any of A alone, B alone, C alone, A and B, B and C, A and C, or all of A, B, and C. The same is indicated by the conventions "one of more of A, B, or C." Similarly, the phrase "A, B, and/or C" is intended to include any of A alone, B alone, C alone, A and B, B and C, A and C, or all of A, B, and C. With parentheticals such as (e.g. A, B, C), it is intended that this refer to any or all of A alone, B alone, or C alone and to any combination thereof that is applicable in the particular context.

And as previously indicated elements, components, or operations should not be regarded as essential unless they are so explicitly described. The teachings contained herein may be adapted to a variety of embodiments arranged and composed in a wide variety of ways.

The above description of various embodiments is intended to be illustrative not exhaustive and is not intended to limit this disclosure, its application, or uses. Those skilled in the art will be able to imagine embodiments not described but that are consistent with the principles and teachings described herein. Therefore, the above description of exemplary embodiments is not intended to limit the scope of this disclosure, which should be defined only in accordance with the following claims and equivalents thereof.

I claim:

1. A method of using a mobility assist device to maneuver on a mattress of a bed, the method performed by a user with a mobility assist device that includes at least two paddles with each paddle including at least a base with a lower surface and a handle, the method comprising:

positioning the mobility assist device against the bed, including at least:

grasping the handles of the paddles with the hands of the user; and placing the lower surfaces of the bases of the paddles against the mattress with the wrists in an anatomically neutral position, the buttocks of the user being in contact with the mattress; and lifting the body with the mobility assist device, the lifting including at least:

with the wrists in the anatomically neutral position, pressing the lower surfaces of the paddles against the mattress; and raising the user's buttocks above the mattress; and wherein the method is performed in at least one of a convalescent, hospital, home care setting, or self-care setting.

2. The method of claim 1, further comprising:

positioning the user's body to an edge of the bed, the positioning the user's body being performed at least in part with the lifting of the body with the mobility assist device.

3. The method of claim 2, wherein the positioning the user's body to the edge of the bed further comprises swinging the user's legs out of the bed and sitting up at the edge of the bed.

4. The method of claim 2, further comprising:

standing, the standing being performed with the user's body at the edge of the bed.

5. The method of claim 4, wherein the standing is further performed by at least:

at least one of gripping or continuing to grip the handles of the paddles with the hands of the user;

placing the lower surfaces of the bases of the paddles against the mattress with the wrists in an anatomically neutral position, the buttocks of the user being in contact with the mattress;

with the wrists in the anatomically neutral position, pressing the lower surfaces of the paddles against the mattress; and with support from the paddles against the mattress, standing.

6. The method of claim 1, the mobility assist device comprising:

two paddles, at least one paddle of the two paddles including at least:

a base defining an upper surface and a lower surface, the lower surface being configured for supporting the base on a mattress of a bed, the base further defining a first end, a second end opposite the first end, a longitudinal axis, a length along the longitudinal axis between the first and second ends, and a width, the length being greater the width; and a handle at least one of integral with or coupled with the base along its longitudinal axis or along an axis that is at least substantially parallel with the longitudinal axis and having a least a gripping portion configured for gripping with a hand of a user, the at least one paddle configured for the handle to be gripped with the wrist of the user in an anatomically neutral position in which the gripping portion is gripped by a hand of the user while at least one of the longitudinal axis of the base or a longitudinal axis of the handle is at least substantially parallel to a sagittal plane through the user; and wherein the mobility assist device is thereby at least partly configured for assisting the user to maneuver about the mattress of the bed.

7. The method of claim 6, wherein the mobility assist device is thereby at least partly configured for assisting the user to maneuver about the mattress of the bed at least in part by being configured to assist the user with at least one of getting into the bed, getting out of the bed, or scooting about the bed.

8. The method of claim 6, wherein the lower surface is a flat surface.

9. The method of claim 6, wherein the lower surface is at least one of at least partially concave or at least partially convex.

10. The method of claim 6, wherein the base is solid without perforations or holes.

11. The method of claim 6, wherein the width of the base is between 45 percent and 70 percent, inclusive, of the length of the base.

12. The method of claim 11, wherein the length of the base is greater than 12 inches.

13. The method of claim 12, wherein the length of the base is greater than 14 inches.

14. The method of claim 6, wherein a length of the handle is between 50 percent and 70 percent, inclusive, of the length of the base.

15. The method of claim 14, wherein the length of the base is greater than 12 inches.

16. The method of claim 15, wherein the length of the base is greater than 14 inches.

17. The method of claim 6, wherein a handle at least one of integral with or coupled with the base along its longitudinal axis or along an axis that is at least substantially parallel with the longitudinal axis and having a least a gripping portion configured for gripping with a hand of a user, the at least one paddle configured for the handle to be gripped with the wrist of the user in an anatomically neutral position in which the gripping portion is gripped by a hand of the user while at least one of the longitudinal axis of the base or a longitudinal axis of the handle is at least substantially parallel to a sagittal plane through the user comprises:

a handle with first and second legs extending from the upper surface of the base, the first and second legs being disposed along the longitudinal axis of the base, or along an axis that is at least substantially parallel with the longitudinal axis of the base, with the first leg disposed at a first distance from the first end and the second leg disposed at a second distance from the second end, the handle defining a gripping portion configured for gripping by a hand, at least a portion of the gripping portion being disposed at a height above the upper surface of the base that prevents the hand from contacting the upper surface of the base when the hand is gripping the gripping portion.

18. The method of claim 17, wherein at least one of the first distance or the second distance is between 15 percent and 25 percent of the length of the base.

19. The mobility device of claim 17, wherein at least one of the first distance or the second distance is between 2.5 and 4 inches.

20. The method of claim 6, wherein at least a portion of at least one of the first leg or the second leg is at least substantially vertical with respect to at least a portion of the lower surface of the base.

21. The method of claim 6, wherein at least a portion of the gripping portion of the handle is at least substantially horizontal with respect to at least a portion of the lower surface of the base.

22. The method of claim 6, wherein the handle and the base are integral with one another to form a one-piece paddle.

23. The method of claim 22, wherein the one-piece paddle is an injection molded plastic paddle.

24. The method of claim 6, wherein the handle and the base are separate parts of the paddle, the handle being coupled with the base.

25. The method of claim 24, wherein the first leg and the second leg are integral with the gripping portion of the handle.

26. The method of claim 24, wherein the first leg and the second leg and the gripping portion of the handle are separate parts that are coupled together to form the handle.

27. The method of claim 6, wherein the base defines a centroid along its longitudinal axis midway between the first end and second end and wherein the gripping portion of the handle is positioned so that when gripped by a user's hand, the user's hand is positioned over the centroid.

28. The method of claim 1, the mobility assist device comprising:

two paddles, at least one paddle of the two paddles including at least:

a base defining an upper surface and a lower surface, the lower surface being configured for supporting the base on a mattress of a bed, the base further defining a first end, a second end opposite the first end, a longitudinal axis, a length along the longitudinal axis between the first and second ends, and a width, the length being greater the width; and a handle with first and second legs extending from the upper surface of the base, the first and second legs extending from along the longitudinal axis of the base, or from along an axis that is at least substantially parallel with the longitudinal axis, with the first leg disposed at a first distance from the first end and the second leg disposed at a second distance from the second end, the handle defining a gripping portion configured for gripping by a hand, at least a portion of the gripping portion being disposed at a height above the upper surface of the base that prevents the hand from contacting the upper surface of the base when the hand is gripping the gripping portion; and wherein the mobility assist device is thereby at least partly configured for assisting the user to maneuver about the mattress of the bed.

* * * * *